US009010555B2

(12) United States Patent
Luzzato et al.

(10) Patent No.: US 9,010,555 B2
(45) Date of Patent: Apr. 21, 2015

(54) STOPPER HAVING A SUBDIVIDED LINE OF WEAKNESS AND A METHOD OF FABRICATING SUCH A STOPPER

(75) Inventors: Michel Luzzato, Ecully (FR); Jerome Mezerette, Saint Didier au Mont d'Or (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 833 days.

(21) Appl. No.: 13/122,118

(22) PCT Filed: Oct. 8, 2009

(86) PCT No.: PCT/FR2009/051921

§ 371 (c)(1),
(2), (4) Date: Mar. 31, 2011

(87) PCT Pub. No.: WO2010/040961

PCT Pub. Date: Apr. 15, 2010

(65) Prior Publication Data

US 2011/0174760 A1 Jul. 21, 2011

(30) Foreign Application Priority Data

Oct. 9, 2008 (FR) ..... 08 56842

(51) Int. Cl.
*B65D 39/00* (2006.01)
*B65D 41/00* (2006.01)
(Continued)

(52) U.S. Cl.
CPC ..... *B65D 55/16* (2013.01); *B65D 41/3447* (2013.01); *B65D 41/48* (2013.01); *B65D 2101/0046* (2013.01)

(58) Field of Classification Search
CPC .. B65D 41/3428; B65D 47/142; B65D 55/16; B65D 2101/0046
USPC ..... 215/252, 253, 258, 306; 220/836, 837
See application file for complete search history.

(56) References Cited

U.S. PATENT DOCUMENTS 5,215,204 A 6/1993 Beck
5,405,032 A * 4/1995 Anderson ..... 215/252
(Continued)

FOREIGN PATENT DOCUMENTS

| | | | |
|---|---|---|---|
| DE | 9314485 | U1 | 12/1993 |
| EP | 1151932 | A | 11/2001 |
| EP | 1529736 | A | 5/2005 |
| FR | 2785264 | A | 5/2000 |

*Primary Examiner* — Fenn Mathew
*Assistant Examiner* — Andrew T Kirsch
(74) *Attorney, Agent, or Firm* — Finnegan, Henderson, Farabow, Garrett & Dunner, L.L.P.

(57) ABSTRACT

The invention relates to a cap (1) that comprises a circular skirt (12), said cap including an irremovable portion (12-2) fixedly attached about the neck of a vessel (2) and a removable portion (12-1) removably attached to the neck, the irremovable and removable portions being separated by a first weakening line (20). In order to maintain the removable portion of the skirt attached to the irremovable portion of the skirt after the first opening, the skirt is provided with a second peripheral weakening line (34). It is also provided that the first weakening line extends less than 360°, while the two ends (34A, 34B) of the second weakening line are located along the periphery of the skirt respectively between a first (28A) of the two ends of a linking portion of the skirt and the hasp (26-1) closest to said first end, and between the second end (28B) of the linking portion and the hasp (26-6) closest to said second end.

13 Claims, 6 Drawing Sheets

Figure 1:
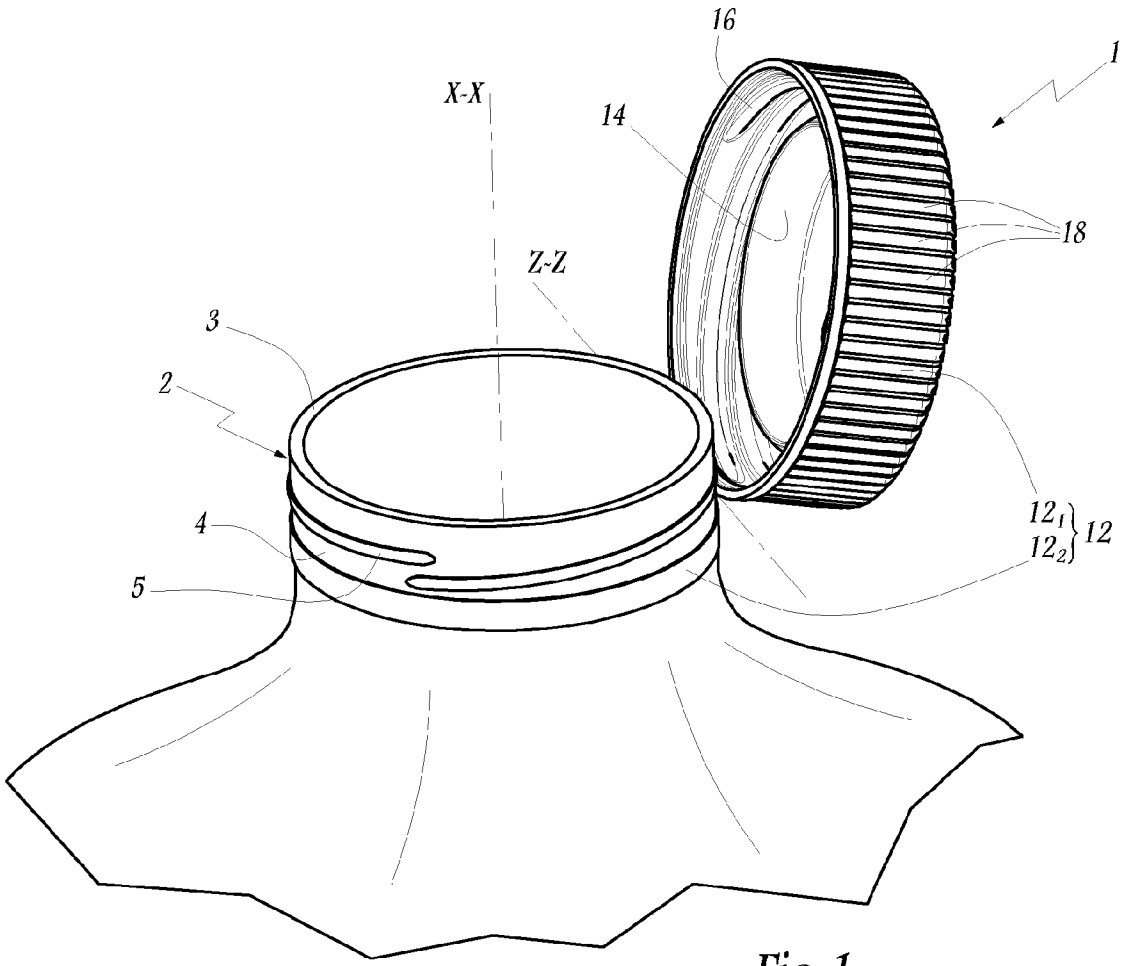

(51) Int. Cl.

| | |
|---|---|
| ***B65D 43/00*** | (2006.01) |
| ***B65D 47/00*** | (2006.01) |
| ***B65D 51/00*** | (2006.01) |
| ***B65D 49/12*** | (2006.01) |
| ***B65D 55/16*** | (2006.01) |
| ***B65D 43/14*** | (2006.01) |
| ***B65D 51/04*** | (2006.01) |
| ***B65D 41/34*** | (2006.01) |
| ***B65D 41/48*** | (2006.01) |

(56) References Cited

U.S. PATENT DOCUMENTS

| | | | | |
|---|---|---|---|---|
| 5,725,115 | A * | 3/1998 | Bosl et al. | 215/252 |
| 5,809,860 | A * | 9/1998 | Haaser | 83/880 |
| 6,474,491 | B1 | 11/2002 | Benoit-Gonin et al. | |
| 2007/0089587 | A1 | 4/2007 | Lial | |

* cited by examiner

STOPPER HAVING A SUBDIVIDED LINE OF WEAKNESS AND A METHOD OF FABRICATING SUCH A STOPPER

This is a U.S. National Phase of PCT/FR2009/051921, filed Oct. 8, 2009, which claims the benefit of priority to FR 0856842, filed Oct. 9, 2008, which is incorporated herein by reference.

The present invention relates to a stopper for a container neck, and to a method of fabricating such a stopper.

The invention relates generally to stoppers in which each stopper has a skirt that surrounds the neck of a container and that has a bottom portion, "bottom" when the neck is extending vertically with its rim pointing upwards, that is designed to remain permanently around the neck after the stopper has been opened for the first time and that is, in particular, in the form of a tamper-proofing band. The remainder of the skirt, i.e. the top portion thereof, is designed to be removable from the neck, while initially being connected to the non-removable bottom portion of the skirt by breakable bridges that are distributed around the periphery of the skirt and that are suitable for being broken when the stopper is opened for the first time. The line of weakness formed by said bridges serves as an indicator to inform users whether or not the stopper has been opened for a first time. In the context of the present invention, the removable tether between the top skirt portion and the neck of the container may be of any type, so that the invention is applicable both for snap-shut stoppers, i.e. stoppers that are suitable for snapping onto bottle necks, and also for screw stoppers.

The invention relates more particularly to stoppers in which the line of weakness is subdivided, i.e. it is made up of a succession of through notches, cut through the wall of the skirt and around the periphery thereof, in such a manner as to define respective ones of the above-mentioned breakable bridges between successive pairs of notches. Obtaining the line of weakness by cutting rather than by molding is preferred because it is less expensive and more practical since it does not require the use of complex molds, e.g. provided with slides. Unfortunately, a line of weakness obtained by cutting is conventionally designed to extend over the entire periphery of the skirt and in a plane perpendicular to the longitudinal axis of the skirt, thereby limiting the possibilities for converting the stoppers, unlike with stoppers in which the line of weakness is obtained by molding, it being possible for such molded lines to include, in particular, a non-breakable portion of material that connects the removable skirt portion to the non-removable skirt portion permanently, even after the stopper has been opened, as proposed in U.S. Pat. No. 5,215,204.

An object of the present invention is to improve fabrication of stoppers having lines of weakness that are cut and to do so in simple and inexpensive manner, so as to have a stopper in which the removable skirt portion remains connected to the non-removable skirt portion after the stopper has been opened for the first time.

To this end, the invention provides a stopper for a container neck, as defined in claim 1.

The basic idea of the invention is to seek to improve existing methods and means making it possible to cut a conventional line of weakness in a stopper firstly so as form said line of weakness over only a portion of the skirt, so as to allow a non-breakable tether portion to remain between the removable skirt portion and the non-removable skirt portion, and secondly so as to cut a second line of weakness that extends over less than one half of the periphery of the skirt and that, when the axis of the skirt is vertical with the non-removable portion of the skirt pointing downwards, is situated vertically above and on either side of the above-mentioned non-breakable tether portion. The notches of said first and second lines of weakness differ from lines of weakness that are molded because, before the stopper is opened for the first time, they have touching edges that, in particular, thereby prevent dust and dirt from accessing the inside of the skirt via said lines of weakness. The second line of weakness is simple and quick to cut insofar as said line of weakness extends in the removable skirt portion that, conventionally, has an axial dimension that is larger than the non-removable skirt portion, which portion is generally merely a narrow tamper-proofing band, the presence of the means for permanently retaining said band around the neck limiting the possibilities of forming the line by cutting. When the stopper of the invention is opened for the first time, the bridges of the first line of weakness break, while the tether portion remains, without it being possible, however, for said tether portion to be driven upwards by the removable skirt portion because the non-removable skirt portion is retained around the container neck. The upward movement of the removable skirt portion, under the action of the user, causes the strip interposed between the first and second lines of weakness to be deformed, and more particularly causes the end portions of said strip that are arranged on either side of the tether portion to be deformed, by the edges of the one or more notches of the second line of weakness coming apart. This deformation of the strip is facilitated by the first line of weakness in that the above-mentioned end portions of the strip are, over their entire lengths, devoid of any bridge along said first line of weakness, except possibly vertically in register with the ends of the second line of weakness.

Thus, the stopper of the invention procures performance as high as the performance obtained with stoppers having molded lines of weakness in that the removable skirt portion remains tethered to the non-removable skirt portion after the stopper has been opened for the first time, via the above-mentioned tether portion, with the significant advantages that the molds for fabricating stoppers of the invention are less complex and less fragile, while also including more molding cavities, than molds for fabricating stoppers having molded bridges. In addition, it is quick and easy to go between fabricating existing stoppers, each of which has a single cut line of weakness, and fabricating stoppers of the invention by adding or by removing the arrangements necessary for cutting the second line of weakness, thereby offering a large degree of flexibility for producing various different stoppers.

Advantageous characteristics of the method of the invention, taken in isolation or in any technically feasible combination, are specified in dependent claims 2 to 9.

The invention also provides a method of fabricating a stopper for a container neck, as defined in claim 10.

This method makes it possible to fabricate a stopper as defined above, with the above-mentioned production advantages.

Figure 2:
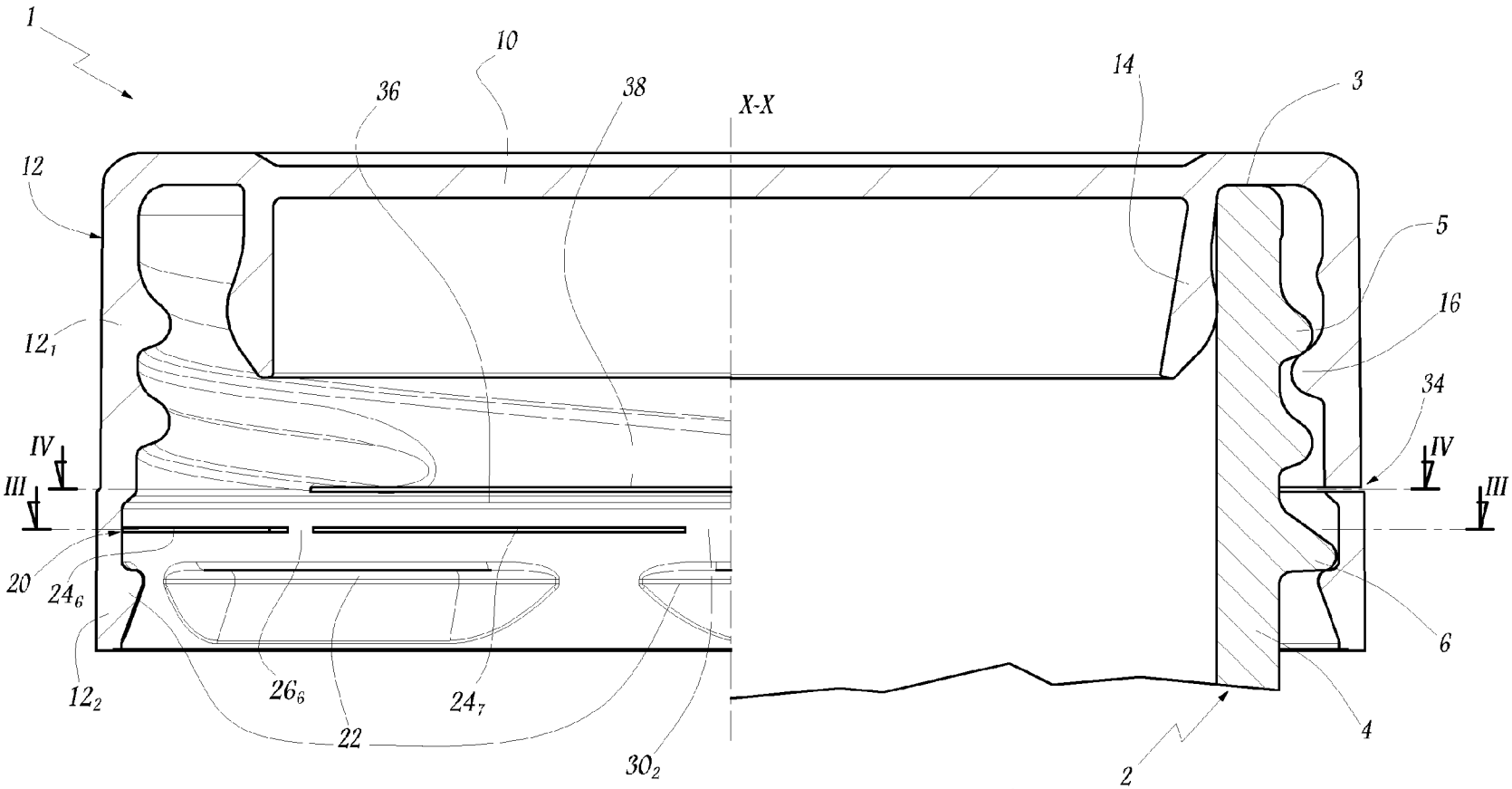
Figure 3:
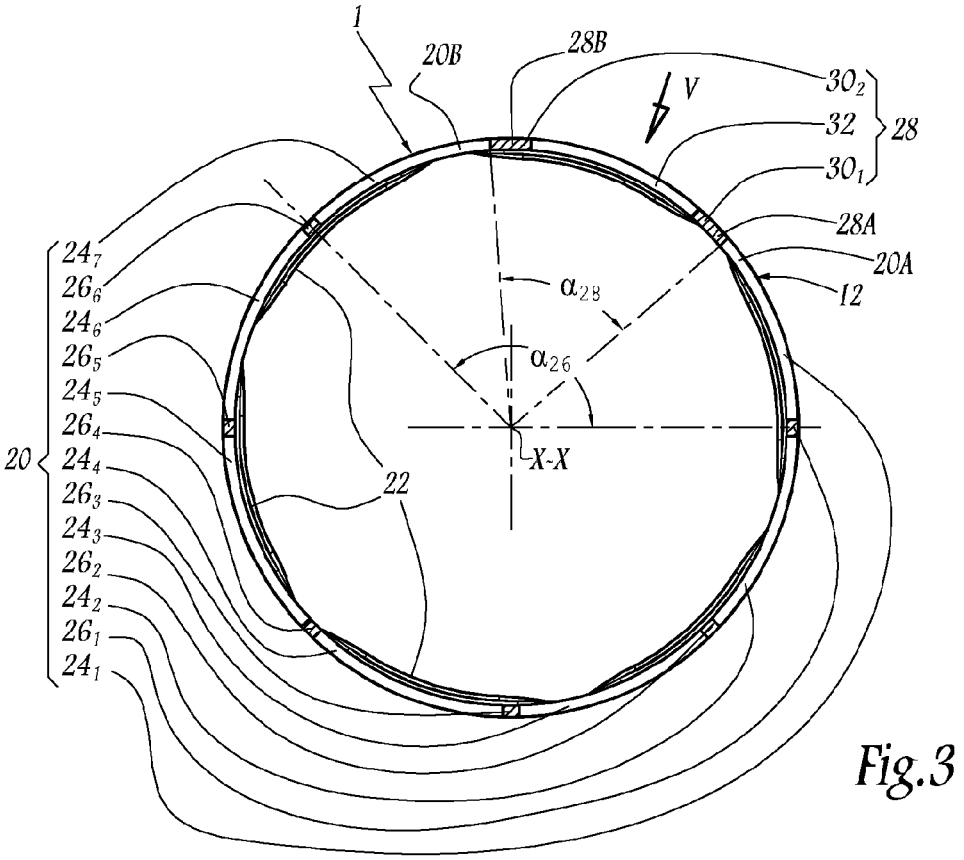
Figure 4:
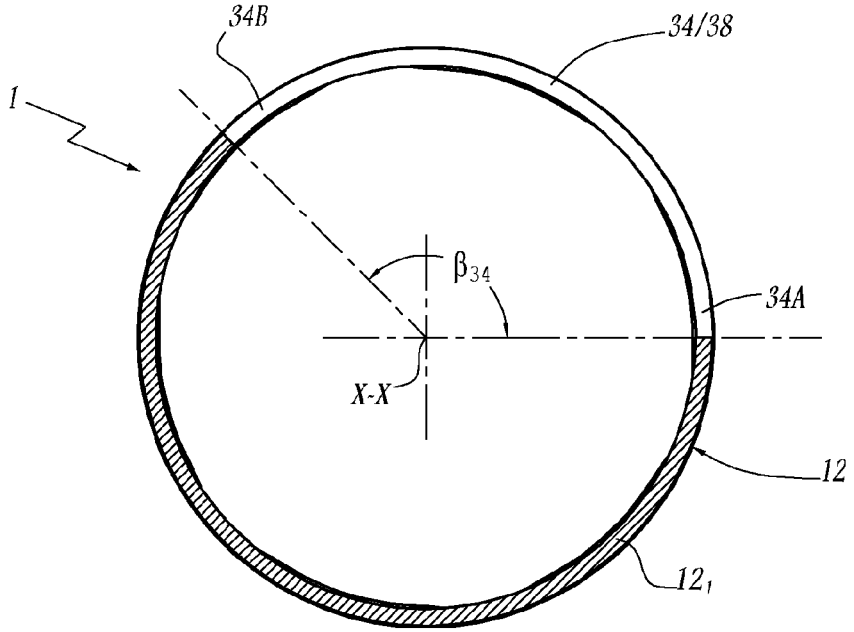
Figure 5:
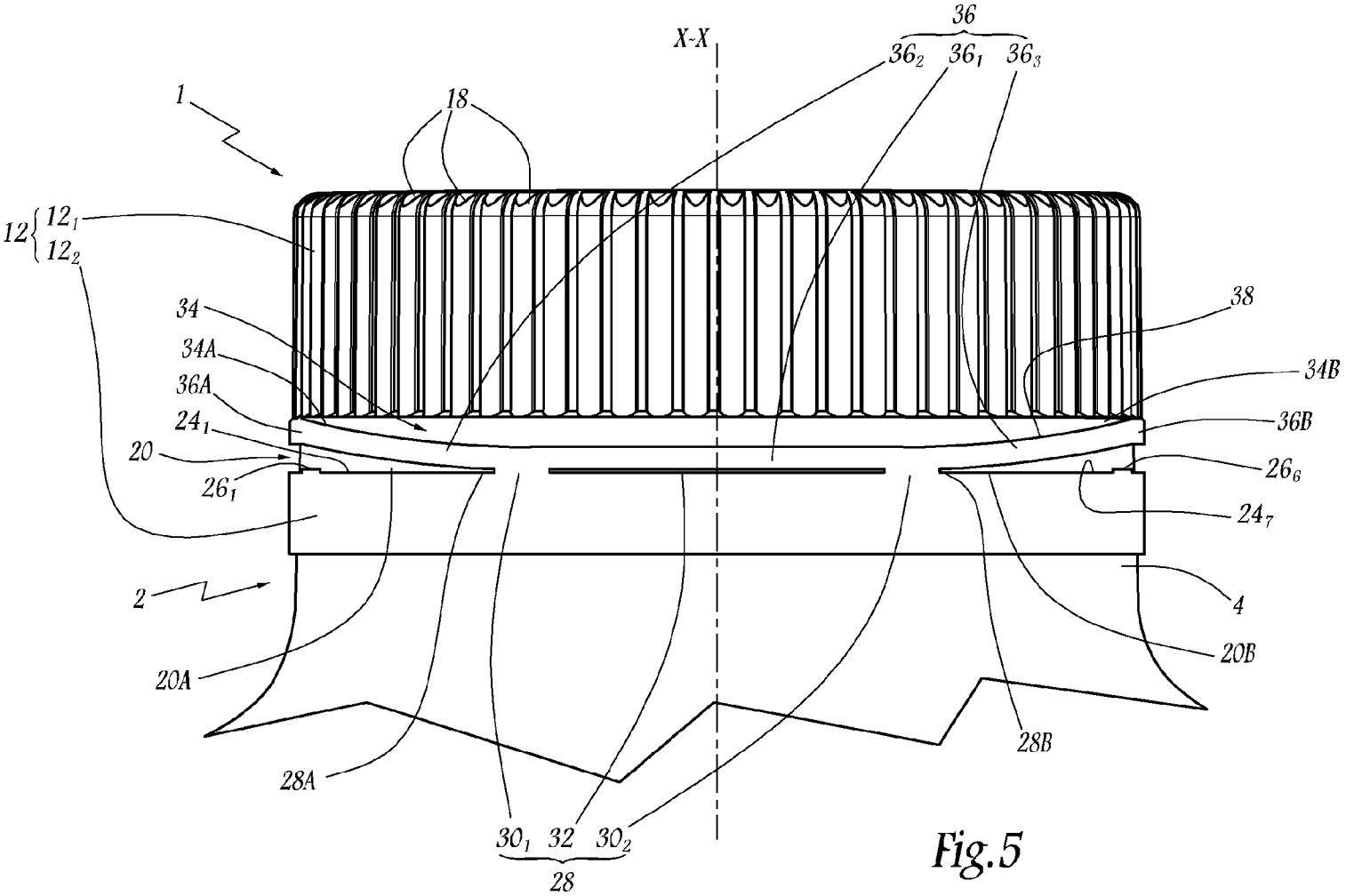
Figure 6:
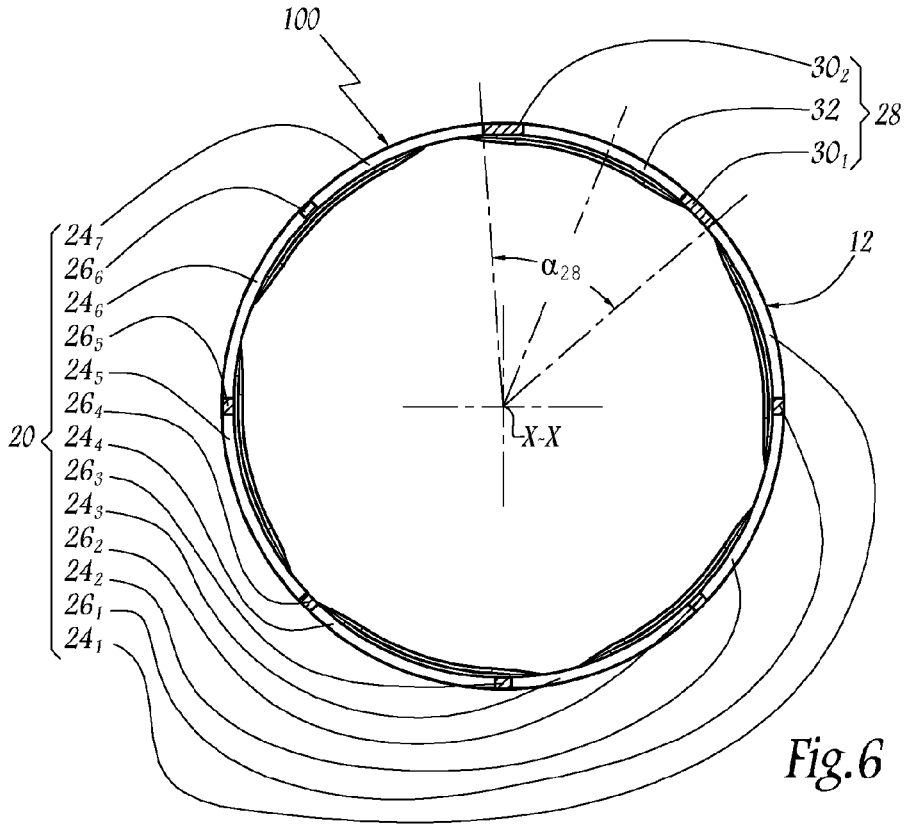
Figure 7:
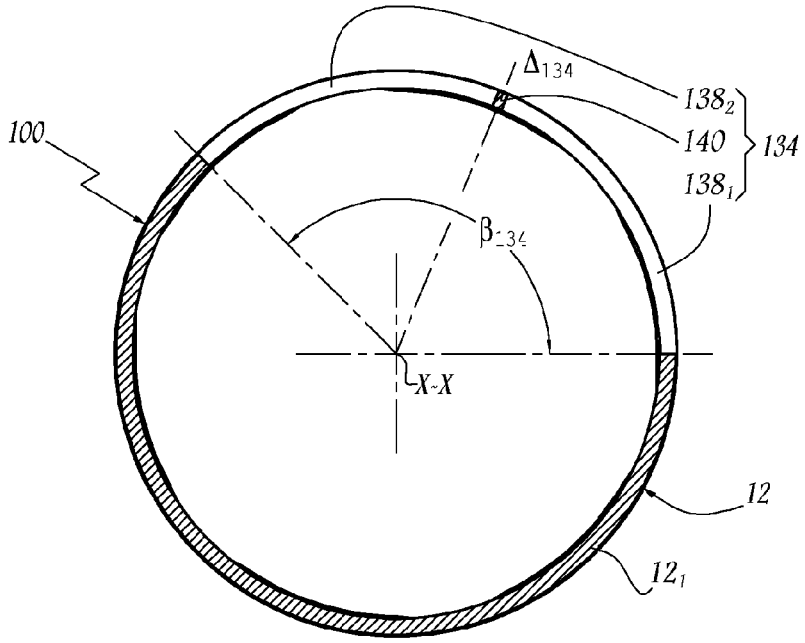
Figure 8:
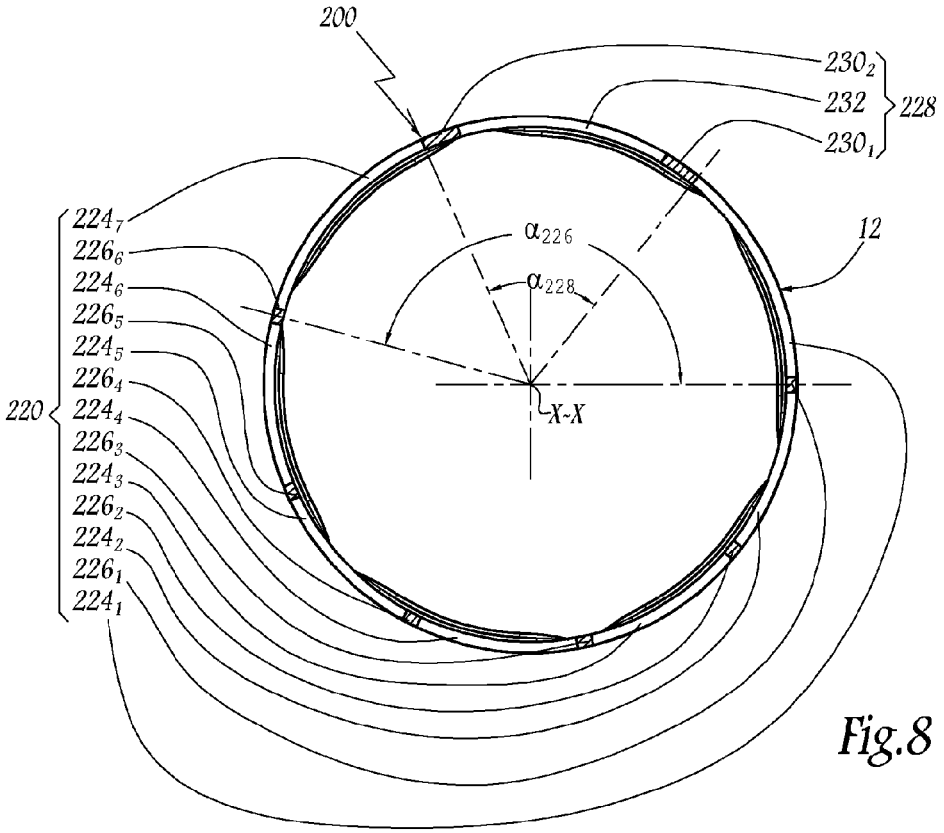
Figure 9:
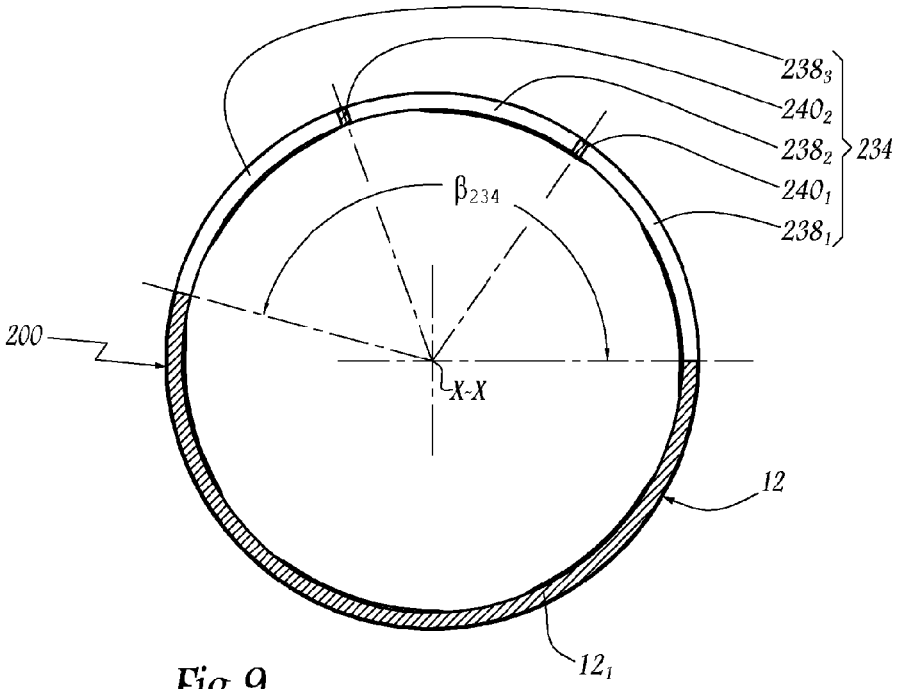

The invention can be better understood on reading the following description given merely by way of example and with reference to the accompanying drawings, in which:

- FIG. 1 is a diagrammatic perspective view of a stopper of the invention, FIG. 1 showing this stopper put in place around a container neck and in an open configuration;
- FIG. 2 is a longitudinal section view of the stopper before it is opened for the first time, the left and right halves of this figure showing the stopper respectively before and after it is put in place around the container neck;
- FIGS. 3 and 4 are sections respectively on the planes III-III and IV-IV of FIG. 2, showing the stopper before it is put in place around the container neck;

FIG. 5 is an elevation view of the stopper as put in place around the container neck and while it is being opened for the first time, the direction in which the view is seen corresponding to arrow V indicated in FIG. 3;

FIGS. 6 and 7 are views respectively analogous to FIGS. 3 and 4, showing a first variant embodiment of the stopper of the invention; and FIGS. 8 and 9 are views respectively analogous to FIGS. 3 and 4, showing a second variant embodiment of the invention.

FIGS. 1 to 5 show a stopper 1 adapted to being fastened removably to a neck 2 of a container. The stopper 1 that is considered herein by way of illustration is a screw stopper that is fastened to the neck by screw fastening. In practice, the neck 2 is either formed integrally with the remainder of the container, in particular when said container is a bottle made of glass or of a plastics material, as shown in FIG. 1, or else it is adapted to being secured permanently to a wall of the container, at a through opening in said wall.

The stopper 1 and the neck 2 have respective shapes that are generally tubular, and that have central longitudinal axes that substantially coincide with each other, as indicated by the reference X-X, when the stopper is screwed onto the neck. For reasons of convenience, the description below considers that the terms "top" and "upwards" correspond to a direction that is generally parallel to the axis X-X and that goes from the body of the container towards its neck 2, i.e. to a direction going towards the tops of FIGS. 1, 2, and 5, whereas the terms "bottom" and "downwards" correspond to the opposite direction.

The neck 2 has a body 4 that is generally cylindrical with the cylindrical shape having a circular base and being of axis X-X. At its top end, the body 4 defines a rim 3 at which the liquid contained in the container is poured out. As shown in the right portion of FIG. 2 only, on the outside face of the body 4, and successively starting from its rim 3, the neck 2 is provided with a thread 5 and with a projection 6, both the thread and the projection extending radially outwards from the body.

The stopper 1, as considered screwed onto the neck 2, is open at its bottom end and is closed at its top end by an end-wall 10, at the outside periphery of which a tubular skirt 12 extends axially downwards, which skirt is centered on the axis X-X and has a circular base. In this example, the stopper is advantageously provided with a lip 14 that extends axially downwards from the end-wall 10 in such a manner as to be centered on the axis X-X, inside the outer skirt 12. When the stopper is screwed onto the neck 2, the end-wall 10 extends above and across said neck, while the skirt 12 surrounds the body 4 externally and the lip 14 is pressed in leaktight manner against the inside face of said body.

The skirt 12 is provided with an inside thread 16 that extends radially towards the inside of the main wall of the skirt in a manner complementary to the thread 5 on the neck 2. Co-operation between the threads 5 and 16 makes it possible to screw and to unscrew the skirt 12 around the neck. Advantageously, in order to make it easier for the user to drive the skirt 12 about the axis X-X, the outside face of said skirt is provided with elongate splines 18 that extend parallel to the axis X-X. Said splines 18 make it easier for the user to take a firm hold of the stopper 1.

When the stopper 1 is opened for the first time, the skirt 12 is adapted to separate into two distinct portions, namely a top portion $\mathbf{12}_1$, formed integrally with the end-wall 10, and a bottom portion $\mathbf{12}_2$, initially connected to the top portion $\mathbf{12}_1$ at a peripheral line of weakness 20 situated axially in the main portion of the skirt. As shown in FIG. 1, the skirt portion $\mathbf{12}_1$ is designed to be disengaged in full from the neck 2 so that said portion $\mathbf{12}_1$ internally carries the screw thread 16, and externally carries the splines 18. The skirt portion $\mathbf{12}_2$ is designed to remain around the neck 2. To this end, the portion $\mathbf{12}_2$ is internally provided with ledges 22 that extend radially by projecting inwards from the inside surface of the skirt 12 and that are situated generally in the same plane, perpendicular to the axis X-X, while being distributed all the way around the periphery of the skirt. When the stopper is assembled on the neck 2, said ledges extend axially below the projection 6 and are adapted, when the stopper is lifted for the first time, to come axially into abutment against said projection.

As can be seen clearly in FIG. 3, the line of weakness 20 generally lies in a plane that is perpendicular to the axis X-X and is made up of peripheral notches, of which there are seven in this example, referenced respectively $\mathbf{24}_1$ to $\mathbf{24}_7$, each of which passes radially through the wall of the skirt 12. These notches $\mathbf{24}_1$ to $\mathbf{24}_7$ succeed one another along the line 20, in other words around the periphery of the skirt. Each pair of two immediately successive notches defines a breakable bridge between the two notches in the pair, which bridge interconnects the skirt portions $\mathbf{12}_1$ and $\mathbf{12}_2$ in the direction of the axis X-X. The six bridges present in this example, and referenced successively $\mathbf{26}_1$ to $\mathbf{26}_6$, are distributed substantially uniformly over the entire length of the line of weakness 20.

As can be seen clearly in FIG. 3, the line of weakness 20 does not extend over the entire periphery of the skirt 12 but instead is interrupted by a portion 28 of the skirt that permanently interconnects the skirt portions $\mathbf{12}_1$ and $\mathbf{12}_2$. This skirt portion 28 lies generally within the same plane that is perpendicular to the axis X-X, and within which the line of weakness 20 lies, while separating, around the periphery of the skirt, the two notches $\mathbf{24}_1$ and $\mathbf{24}_7$ that are situated at respective ones of the two ends 20A and 20B of the line of weakness 20. For practical reasons that can be understood below, the skirt portion 28 is situated on the side of the stopper 1 that is considered to be the rear side of the stopper, insofar as this side, when in service, is designed to face away from the user.

The skirt portion 28 extends, about the axis X-X, through an angle $\alpha_{28}$ that, in the embodiment shown in FIGS. 1 to 5, is approximately equal to 50°, but that, in practice, has a value lying in the range 5° to 90°, and preferably in the range 40° to 70°.

As can be seen clearly in FIG. 3, at each of its two peripheral ends 28A and 28B, the skirt portion 28 has a non-breakable bridge $\mathbf{30}_1$, $\mathbf{30}_2$ that is formed integrally with the skirt portions $\mathbf{12}_1$ and $\mathbf{12}_2$. Around the periphery of the skirt, the bridges $\mathbf{30}_1$ and $\mathbf{30}_2$ are separated by a notch 32 passing radially through the wall of the skirt 12.

The skirt 12 is further provided with a second peripheral line of weakness 34 that is distinct from the line of weakness 20. As can be seen clearly in FIG. 4, this line of weakness 34 lies within a plane that is perpendicular to the axis X-X, while being defined in the removable skirt portion $\mathbf{12}_1$, so that, as shown in FIG. 2, a non-breakable strip 36 constituted by a peripheral fragment of the wall of the skirt 12 and belonging to the removable skirt portion $\mathbf{12}_1$ is interposed in the direction of the axis X-X between the lines of weakness 20 and 34.

In the embodiment shown in FIGS. 1 to 5, the line of weakness 34 is made up, over its entire length, of a single peripheral notch 38 that passes radially through the wall of the skirt portion $\mathbf{12}_1$.

The line of weakness 34 extends about the axis X-X, through an angle $\beta_{34}$ that, in the embodiment shown in FIGS. 1 to 5, is equal to 135° but that, in practice, takes a value strictly less than 180°, chosen advantageously in the range 60° to 175°, and preferably in the range 90° to 170°.

In addition, provision is made for the angular positioning of the line of weakness 34 about the axis X-X to be such that its two peripheral ends 34A and 34B are situated, around the periphery of the skirt 12, on either side of the skirt portion 28, without going beyond the respective breakable bridges that are closest to the ends 28A and 28B of said portion 28 along the line of weakness 20, namely the bridges $\mathbf{26}_1$ and $\mathbf{26}_6$. In other words, as can be seen clearly in FIG. 5 that is described in detail below, the ends 34A and 34B of the line of weakness 34 are situated in vertical register either with respective ones of peripheral points of the notches $\mathbf{24}_1$ and $\mathbf{24}_7$, or with respective ones of the bridges $\mathbf{26}_1$ and $\mathbf{26}_6$, as applies for the embodiment considered herein. This means that, in this example, the angle, referenced $\alpha_{26}$ in FIG. 3, between the radii relative to the axis X-X that pass through respective ones of the bridges $\mathbf{26}_1$ and $\mathbf{26}_6$ has a value and angular positioning about the axis X-X that are identical to the value and to the angular positioning of the angle $\beta_{34}$.

In this way, as referenced in FIG. 5, the strip 36 includes: a main portion $\mathbf{36}_1$ permanently connected, over its entire length, to the non-removable skirt portion $\mathbf{12}_2$ via the tether portion 28; and two end portions $\mathbf{36}_2$ and $\mathbf{36}_3$ that are respectively separate both from the non-removable skirt portion $\mathbf{12}_2$ because of the notches $\mathbf{24}_1$ and $\mathbf{24}_7$, and from the remainder of the removable skirt portion $\mathbf{12}_1$ because of the notch 38, except at the peripheral ends 36A and 36B of the strip 36, which ends are formed integrally with the remainder of the skirt portion $\mathbf{12}_1$ and, before the stopper 1 is opened for the first time, are connected in the direction of the axis X-X to the skirt portion $\mathbf{12}_2$ via respective ones of the bridges $\mathbf{26}_1$ and $\mathbf{26}_6$.

In addition, in order to guarantee uniform behavior by the strip 36, in particular by its end portions $\mathbf{36}_2$ and $\mathbf{36}_3$, around the periphery of the skirt 12, the skirt portion 28 and the line of weakness 34 are centered on each other in that the bisector of the angle $\alpha_{28}$ occupies the same angular position, about the axis X-X, as the bisector of the angle $\beta_{34}$.

When the user opens the stopper 1 for the first time by causing the skirt portion $\mathbf{12}_1$ to turn about the axis X-X so as to unscrew it from the neck 2, the skirt portion $\mathbf{12}_2$ is retained, in the direction of the axis X-X, about the neck by the projection 6, while the skirt portion $\mathbf{12}_1$ is moved upwards away from the skirt portion $\mathbf{12}_2$. For this purpose, the lines of weakness 20 and 34 are stressed jointly. More precisely, the skirt portion 28 holds the central portion $\mathbf{36}_1$ of the strip 36 stationary relative to the skirt portion $\mathbf{12}_2$, whereas the end portions $\mathbf{36}_2$ and $\mathbf{36}_3$ of said strip deform along their length, by means of the edges of the notch 38 and the edges of the notches $\mathbf{24}_1$ and $\mathbf{24}_7$ coming freely apart from each other, without being hindered by the presence of bridges that would induce a certain amount of resistance. The portions $\mathbf{36}_2$ and $\mathbf{36}_3$ of the strip 36 are thus deployed over their entire lengths relative to the remainder of the skirt portion $\mathbf{12}_1$ and relative to the skirt portion $\mathbf{12}_2$. At substantially the same time, the various bridges $\mathbf{26}_1$ to $\mathbf{26}_6$ break simultaneously. The stopper 1 is then in the configuration shown in FIG. 5.

By continuing to unscrew the skirt portion $\mathbf{12}_1$, the strip portions $\mathbf{36}_2$ and $\mathbf{36}_3$ deform to a greater extent, by going progressively from a configuration in which they extend substantially horizontally to a configuration in which they extend in a manner inclined relative to the horizontal, until the threads 5 and 16 are fully disengaged. The user can then tilt the skirt portion $\mathbf{12}_1$ backwards, by using the skirt portion 28 as a hinge tilting about an axis Z-Z that is substantially circumferential relative to the axis X-X and that passes through the bridges $\mathbf{30}_1$ and $\mathbf{30}_2$, as shown in FIG. 1. The hinge-like tilting of the skirt portion 28 is facilitated by the presence of the notch 32 in that said notch limits the stresses necessary for twisting the bridges $\mathbf{30}_1$ and $\mathbf{30}_2$ about the axis Z-Z.

In order to fabricate the stopper 1, the skirt 12 is initially closed by the end-wall 10 and is also provided with the lip 14, with the thread 16, with the splines 18, and with the ledges 22. This skirt is obtained, in particular, by molding a plastics material.

Then, using a first cutting blade (not shown in the figures), both the line of weakness 20 and the portion 28 are formed, in that said first blade passes through the wall of the skirt 12 so as to cut the notches $\mathbf{24}_1$ to $^{24}{}_7$, and the notch 32. Using a second cutting blade, the line of weakness 34 is formed by causing the blade to pass through the wall of the skirt portion $\mathbf{12}_1$ in such a manner as to cut the notch 38. Naturally, the cutting action using the first blade and the cutting action using the second blade are indexed both along the axis X-X and angularly about said axis in such a manner as to obtain the appropriate relative positioning between firstly the line of weakness 20 and the skirt portion 28, and secondly the line of weakness 34.

In practice, the cutting actions using the above-mentioned first and second blades are performed either one after the other, or, preferably, simultaneously, by driving the skirt 12 and said cutting blades relative to one another in rotation about the axis X-X.

FIGS. 6 and 7 show a variant embodiment of the stopper 1, referenced 100. The stopper 100 differs from the stopper 1 only by its second line of weakness, referenced 134. Since the other components of the stopper 100 are identical to the components of the stopper 1, they bear the same alphanumerical references.

As can be seen clearly in FIG. 7, the line of weakness 134 is made up of two peripheral notches $\mathbf{138}_1$ and $\mathbf{138}_2$ that succeed each other around the periphery of the skirt portion $\mathbf{12}_1$, with a breakable bridge 140 being interposed that, in the direction of the axis X-X, interconnects the strip 36 and the remainder of the skirt portion $\mathbf{12}_1$. Said bridge 140 serves on unmolding the stopper, and also while the stopper 100, after it has been fabricated, is being assembled around the container neck 2, in particular by being forcibly engaged around the neck, until the ledges 22 are brought into engagement under the projection 6, to prevent the edges of the line of weakness 134 from coming apart, or at least to limit the extent to which they come apart.

When the stopper 100 is opened for the first time, the bridge 140 breaks so as to enable the edges of the line of weakness 134 to come apart from each other. In practice, the breaking strength of said bridge 140 is low insofar as the bisector $\Delta_{134}$ of the angle $\beta_{134}$ passes through said bridge 140; thus, the bridge 140 is situated angularly, about the axis X-X, in the zone of the line of weakness 134 in which the strongest axial stresses are applied while the stopper 100 is being opened.

FIGS. 8 and 9 show another variant of the stopper 1, referenced 200. Components of the stopper 200 that are identical to components of the stopper 1 bear the same alphanumeric references.

The stopper 200 differs from the stopper 1 by its second line of weakness 234 that comprises three peripheral notches $\mathbf{238}_1$, $\mathbf{238}_2$ and $\mathbf{238}_3$ that succeed one another around the periphery of the skirt portion $\mathbf{12}_1$, with a breakable bridge $\mathbf{240}_1$ being interposed between the notches $\mathbf{238}_1$ and $\mathbf{238}_2$ and with another breakable bridge $\mathbf{240}_2$ being interposed between the notches $\mathbf{238}_2$ and $\mathbf{238}_3$. In a manner analogous to the bridge 140, the bridges $\mathbf{240}_1$ and $\mathbf{240}_2$ keep the notches $\mathbf{238}_1$ to $\mathbf{238}_3$ closed while the stopper is being unmolded, and while it is being assembled to the neck 2.

In addition, as can be seen clearly by comparing FIGS. 4 and 9, the value of the angle $\beta_{234}$ is greater than the value of the angle $\beta_{34}$. In the example shown in FIG. 9, $\beta_{234}$ is equal to about 165°.

The stopper 200 also differs from the stopper 1 by the angular dimensioning of its first line of weakness 220 and of its tether portion 228, as can be seen clearly by comparing FIGS. 3 and 8, it being observed, however, that the structure, per se, of the line of weakness 220 and of the skirt portion 228 is similar to the structure of the line of weakness 20 and of the skirt 28 of the stopper 1. Thus, the line of weakness 220 is made up of seven notches $\mathbf{224}_1$ to $\mathbf{224}_7$ that are respectively analogous to the notches $\mathbf{24}_1$ to $\mathbf{24}_7$, and of six breakable bridges $\mathbf{226}_1$ to $\mathbf{226}_6$ that are respectively analogous to the bridges $\mathbf{26}_1$ to $\mathbf{26}_6$. Similarly, the skirt portion 228 is made up successively of an end bridge $\mathbf{230}_1$, of a peripheral notch 232, and of an opposite end bridge $\mathbf{230}_2$ that are respectively analogous to the bridge $\mathbf{30}_1$, to the notch 32, and to the bridge $\mathbf{30}_2$.

However, the angle $\alpha_{226}$ associated with the bridges $\mathbf{226}_1$ and $\mathbf{226}_7$ of the line 220 has a value greater than the angle $\alpha_{26}$, in such a manner that said angle $\alpha_{226}$ has a value and angular positioning about the axis X-X that are identical to the value and to the angular positioning of the angle $\beta_{234}$.

In addition, the angle $\alpha_{228}$ associated with the skirt portion 228 has a value greater than the angle $\alpha_{28}$: in the embodiment shown in FIG. 8, the angle $\alpha_{228}$ is equal to about 60°.

In this way, the skirt portion 228 and the line of weakness 234 are dimensioned such that the bridge $\mathbf{230}_1$ and the bridge $\mathbf{240}_1$ are aligned in the direction of the axis X-X, and the bridge $\mathbf{230}_2$ and the bridge $\mathbf{240}_2$ are also aligned in said same direction. In this way, when the stopper 200 is opened for the first time, the bridges $\mathbf{240}_1$ and $\mathbf{240}_2$ break as soon as the skirt portion $\mathbf{12}_1$ starts being driven upwards due to it being unscrewed because said bridges are angularly positioned, about the axis X-X, in vertical register with the most rigid zones of the skirt portion 228, namely the bridges $\mathbf{230}_1$ and $\mathbf{230}_2$.

Various arrangements and variants may be made to the stoppers 1, 100, and 200 as described above and to the method of fabricating them as described above. By way of example:

- as regards the line of weakness 20 or 220, the number of its notches, and thus of its bridges, may be different from the number shown in the figures;
- as regards the skirt portion 28 or 228, it may be devoid of the notch 32 or 232, i.e. the skirt portion may be constituted by a non-breakable single bridge that extends through the entire angle $\alpha_{28}$ or $\alpha_{228}$ and that can therefore be referred to as a "wide bridge";
- as regards the line of weakness 34, 134, or 234, it may have more than two breakable bridges, such as the bridges $\mathbf{240}_1$ and $\mathbf{240}_2$, in particular if it is desired to reinforce the strength of said line of weakness while unmolding the stopper and while assembling it around the container neck;
- it is recalled that the removable fastening of the stopper 1, 100, or 200 to the neck 2 can be organized otherwise than by screw-fastening, in particular by snap-fastening, the skirt portion $\mathbf{12}_1$ then being provided internally with a snapping band, optionally fragmented into a plurality of distinct snap-fasteners, suitable for being put into engagement with an outwardly projecting edge provided at the top end of the neck; and/or
- permanently retaining the skirt portion $\mathbf{12}_2$ around the neck 2 may be obtained by embodiments other than ledges 22.

The invention claimed is:

1. A stopper for a container neck, which stopper includes a tubular skirt extending from an end-wall of the stopper, the skirt being suitable for surrounding the neck and provided with a first peripheral line of weakness that is made up both of cut through notches that succeed one another around the periphery of the skirt, and also, between said notches, of non-cut breakable bridges that are adapted to being broken when the stopper is opened for the first time and that, before the stopper is opened for the first time, interconnect, in the direction of the axis of the skirt, a non-removable skirt portion of the skirt, which non-removable skirt portion is provided with retainer means for retaining it permanently around the neck, and a removable skirt portion of the skirt, which removable skirt portion is provided with fastener means for fastening it removably to the neck;

wherein the skirt is provided with a second peripheral line of weakness that extends through less than 180° about the axis of the skirt, that is made up of at least one cut through notch and that is defined in the removable skirt portion in a manner distinct from the first line of weakness, with a non-breakable strip being interposed in the direction of the axis of the skirt;

wherein the first line of weakness extends through less than 360° about the axis of the skirt such that the two notches situated at respective ones of the peripheral ends of the first line of weakness are separated by a tether portion of the skirt that is not cut, at least in part, and that is adapted to interconnect the non-removable skirt portion and the strip non-breakably, while the two peripheral ends of the second line of weakness are situated, around the periphery of the skirt, respectively between a first one of the two peripheral ends of the tether portion and the bridge that is closest to said first end along the first line of weakness, and between the second peripheral end of the tether portion and the bridge that is closest to said second end along the first line of weakness;

wherein the second line of weakness is located axially closer to the end-wall than the first line of weakness, wherein the removable skirt portion and the non-removable skirt portion are arranged, in the direction of the axis of the skirt, on either side of the first line of weakness; and wherein the at least one cut through notch of the second line of weakness is arranged, in the direction of the axis of the skirt, between the strip of the removable skirt portion and the rest of the removable skirt portion.

2. A stopper according to claim 1, wherein the tether portion is adapted to interconnect the non-removable skirt portion and the strip tiltably about an axis that is substantially circumferential relative to the axis of the skirt.

3. A stopper according to claim 1, wherein the two peripheral ends of the second line of weakness are aligned, in the direction of the axis of the skirt, respectively with the bridge that is closest to the first end of the tether portion and the bridge that is closest to the second end of the tether portion.

4. A stopper according to claim 1, wherein the tether portion extends through more than 5° and through less than 90° about the axis of the skirt.

5. A stopper according to claim 4, wherein the tether portion extends through more than 40° and through less than 70° about the axis of the skirt.

6. A stopper according to claim 1, wherein the tether portion is constituted by a non-breakable single bridge.

7. A stopper according to claim 1, wherein, at each of its peripheral ends, the tether portion is provided with a non-breakable bridge and, in its main portion, said tether portion is provided with at least one cut through notch.

8. A stopper according to claim 1, characterized in that the second line of weakness extends through more than 60° and through less than 175° about the axis of the skirt.

9. A stopper according to claim 8, wherein the second line of weakness extends through more than 90° and through less than 170° about the axis of the skirt.

10. A stopper according to claim 1, wherein the second line of weakness is made up of two cut through notches and of one breakable bridge interposed between said two notches around the periphery of the skirt.

11. A stopper according to claim 10, wherein said bridge of the second line of weakness is positioned substantially in the middle of the second line of weakness.

12. A stopper according to claim 1, wherein the second line of weakness is made up of at least three cut through notches and of breakable bridges interposed between successive ones of said notches around the periphery of the skirt, each of the breakable bridges of the second line of weakness preferably being aligned, in the direction of the axis of the skirt, with the non-breakable bridge constituting the tether portion or else with one of the non-breakable bridges belonging to the tether portion.

13. A method of fabricating a stopper for a container neck, in which method there is provided a tubular skirt extending from an end-wall of the stopper, the skirt being suitable for surrounding the neck, and provided both with retainer means for retaining it permanently around the neck, and also with fastener means for fastening it removably to the neck;

and in which method the skirt and a first blade are driven in rotation relative to each other about the longitudinal axis of the skirt so that the first blade cuts a first peripheral line of weakness in the skirt, which first line of weakness is made up both of cut through notches and also, between said notches around the periphery of the skirt, of non-cut breakable bridges that are adapted to being broken when the stopper is opened for the first time and that, before the stopper is opened for the first time, interconnect, in the direction of the axis of the skirt, a non-removable skirt portion of the skirt, which non-removable skirt portion is provided with the retainer means, and a removable skirt portion of the skirt, which removable skirt portion is provided with the fastener means;

wherein the skirt and a second blade are driven relative to each other about the axis of the skirt through less than 180° so that the second blade cuts a second peripheral line of weakness in the removable skirt portion with a non-breakable strip being interposed in the direction of the axis of the skirt, the second line of weakness being made up of at least one cut through notch;

wherein the second line of weakness is located axially closer to the end-wall than the first line of weakness, wherein the removable skirt portion and the non-removable skirt portion are arranged, in the direction of the axis of the skirt, on either side of the first line of weakness:

wherein the at least one cut through notch of the second line of weakness is arranged, in the direction of the axis of the skirt, between the strip of the removable skirt portion and the rest of the removable skirt portion; and wherein the skirt and the first blade are driven in rotation relative to each other over an angular stroke that is strictly less than 360° about the axis of the skirt so that the two notches situated at respective ones of the peripheral ends of the first line of weakness are separated by a tether portion of the skirt that is not cut, at least in part, by the first blade and that is adapted to interconnect the non-removable skirt portion and the strip non-breakably, while the skirt and the second blade are driven in rotation relative to each other in such a manner that the two peripheral ends of the second line of weakness are situated, around the periphery of the skirt, respectively between a first one of the two peripheral ends of the tether portion and the bridge that is closest to said first end along the first line of weakness, and between the second peripheral end of the tether portion and the bridge that is closest to said second end along the first line of weakness.

* * * * *